United States Patent [19]

Hans et al.

[11] Patent Number: 4,700,891

[45] Date of Patent: Oct. 20, 1987

[54] ELECTROMAGNETICALLY ACTUATABLE FUEL INJECTION VALVE

[75] Inventors: Waldemar Hans; Wilhelm Kind, both of Bamberg; Heinrich Knapp, Leonberg; Wolfgang Kramer, Kemmern; Rudolf Sauer, Beninngen, all of Fed. Rep. of Germany

[73] Assignee: Robert Bosch GmbH, Stuttgart, Fed. Rep. of Germany

[21] Appl. No.: 912,469

[22] Filed: Sep. 29, 1986

[30] Foreign Application Priority Data

Oct. 2, 1985 [DE] Fed. Rep. of Germany ..... 3535124

[51] Int. Cl.[4] ..... F02M 51/06

[52] U.S. Cl. ..... 239/132.5; 239/585; 251/129.21

[58] Field of Search ..... 239/585, 132.5, 132.3, 239/132.1; 251/129.21, 129.22

[56] References Cited

U.S. PATENT DOCUMENTS 4,116,389 9/1978 Furtah et al. ..... 239/585
4,483,484 11/1984 Hafner et al. ..... 239/585
4,625,919 12/1986 Soma et al. ..... 239/585

*Primary Examiner*—Andres Kashnikow
*Assistant Examiner*—Karen B. Merritt
*Attorney, Agent, or Firm*—Edwin E. Greigg

[57] ABSTRACT

A magnetic injection valve for injecting fuel into the intake tract of internal combustion machines, which is distinguished by particularly good internal cooling. A magnetic coil wound onto a coil carrier is located in the valve, being introduced into a valve housing and surrounds a ferromagnetic core. The core acts upon an armature which is connected to a movable valve needle. A bushing in the core and a sleeve located outside the core are arranged such that the fuel, emerging from an inflow tract of a supply device flows via the sleeve serving as a fuel line and reaches the interior of the valve housing that receives the magnetic coil; after flowing virtually completely around the magnetic coil, the fuel leaves this interior via a bore and flows back between the bushing and the core as far as the end of the bushing, and then flows on through the bushing to reach the armature to flow on to the valve seat. For better cooling of the magnetic coil, flow conduits are machined into the coil holder such that the fuel flow virtually surrounds the coil.

19 Claims, 1 Drawing Figure

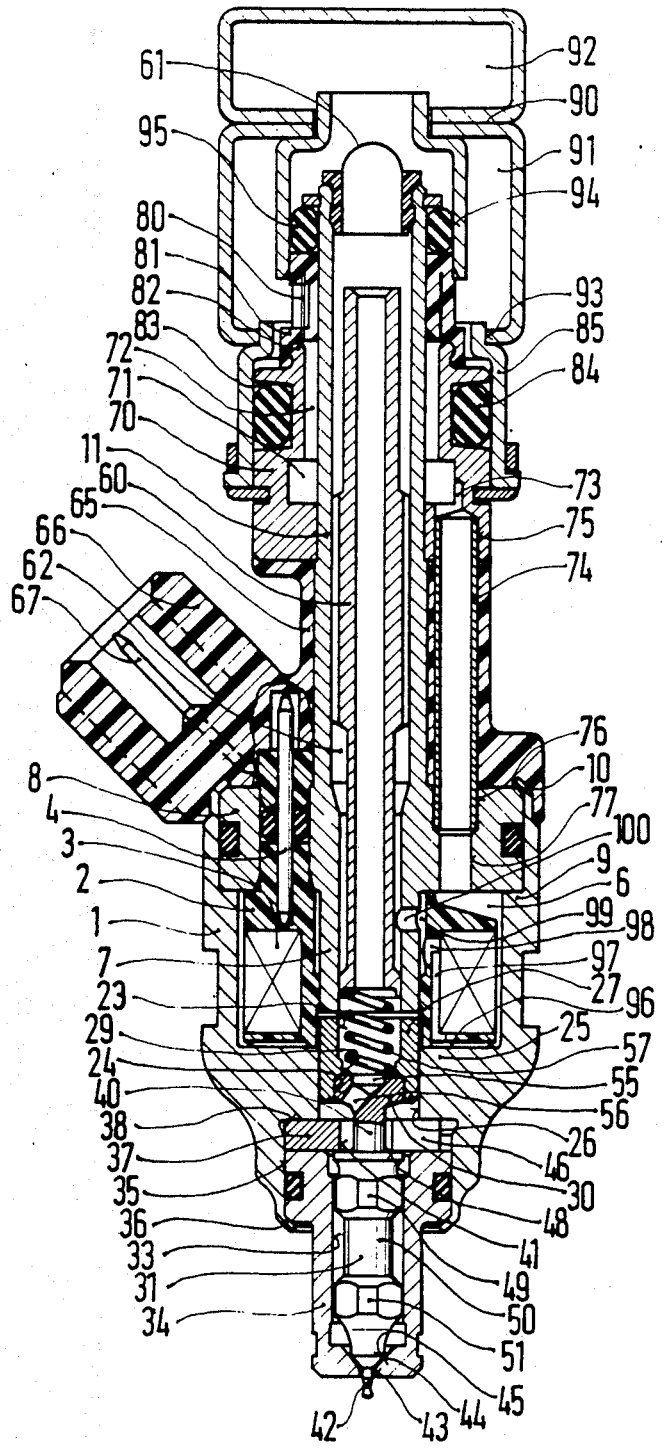
61
95
80
81
82
83
72
71
70
11
60
65
66
62
67
8
4
3
2
1
7
23
29
24
40
38
37
35
36
33
31
34
42
43
44
45
51
50
49
41
48
30
46
26
56
55
57
25
96
27
97
98
99
6
9
100
77
10
76
74
75
73
84
85
93
94
91
90
92

ELECTROMAGNETICALLY ACTUATABLE FUEL INJECTION VALVE

BACKGROUND OF THE INVENTION

The invention is based on an electromagnetically actuatable fuel injection valve for internal combustion engines. A fuel injection valve is already known in which the fuel flowing to the valve seat first flows around the magnetic coil, on the one hand so as to cool the magnetic coil and on the other hand so that as the fuel flows through the fuel injection valve the fuel will carry any vapor bubbles that may possibly arise along with it into a return line.

When an internal combustion engine is started while hot, problems may arise in adapting the mixture, because in the first few seconds after starting, fuel mixed with vapor bubbles also reaches the valve seat. Because of its marked unreadiness to ignite, such fuel can greatly impair the operational readiness of an internal combustion engine.

OBJECT AND SUMMARY OF THE INVENTION

The magnetic injection valve according to the invention has an advantage over the prior art that even in the first few decisive seconds after hot starting, fuel that is largely free of vapor bubbles and hence is ready to ignite is injected into the intake tract of the engine. This is attained by providing the interior of the magnetic fuel injection valve, which is flushed by the fuel, with a large heat-absorbing surface area. By diverting the course of the fuel flow twice between the connecting pipe and the valve seat, the quantity of fuel without its highly volatile ingredients stored in the valve at all times is increased, and in this way the availability of this important fuel for the first few seconds after hot starting is assured.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE is a simplified sectional view of a fuel injection valve according to the invention.

DESCRIPTION OF THE PREFERRED EMBODIMENT

In the magnetic injection valve shown in the drawing, intended for injecting fuel, preferably into the intake tract of a mixture-compressing internal combustion engine, there is a valve housing 1, which in a first approximation is cup-shaped, and in which a magnetic coil 3 is disposed on a coil holder 2. For its current supply, the magnetic coil 3 has a contact lug 4, which leads out of the magnetic coil and coil holder 2.

The coil holder 2 of the magnetic coil 3 is mounted on a tubular core 7 made of ferromagnetic material in an interior 6 of the valve housing 1. The core 7 protrudes partway into the interior 6 of the valve housing 1 and closes off the interior 6 with a flange 8. On one end, the flange 8 is seated on a step 9 of the housing 1, and on the other end the flange is partly encompassed by a crimp 10 of the valve housing 1 compresses the flange against the step 9. On the side remote from the magnetic coil 3, the core 7 is extended in the form of a connecting pipe 11. Remote from the flange 8 of the core 7, the interior

6 of the valve housing 1 is defined by a magnetic flux conducting step 25 of the valve housing 1, which extends radially inward and has a through bore 26 in alignment with the core 7. The coil holder 2 is seated on the magnetic flux conducting step 25. Pointing toward the core 7, an annular armature 27 protrudes with little play into the through bore 26 of the magnetic flux conducting step. The armature 27 has a first blind bore 23, oriented toward the core 7, and a second blind bore 24, remote from the core 7, that is coaxial with the first blind bore 23 and in alignment with the valve axis. The first and second blind bores 23, 24 are joined with one another by means of a coaxial connecting bore 29 having a smaller diameter than the diameter of the first and second blind bores 23, 24. The second blind bore 24 of the armature 27 receives the head 30 of a nozzle needle 31 in a positive or form-fitting manner. The nozzle needle 31 is extended, remote from the armature 27, into a guide bore 33 of a nozzle body 34, which is inserted partway into a retaining bore 35 of the valve housing 1 and is pressed by a crimp 36 formed on the valve housing 1 against a stop plate 37, which rests on an inner shoulder 38 of the valve housing 1 formed by the magnetic flux conducting step 25. With a restriction 40, the nozzle needle 31 passes through a through opening 41 in the stop plate 37 and with a needle tang 42 protrudes out of an injection opening 43 of the nozzle body 34. A conical valve seat face 44 is formed near the opening 43, which cooperates with a conical sealing section 45 on the nozzle needle 31 near the needle tang 42. Between the through opening 41 in the stop plate and the circumference of the stop plate 37, a recess 46 is provided, the inside diameter of which is larger than the diameter of the restriction 40 of the nozzle needle 31. The restriction 40 is adjoined by a stop shoulder 48 of the nozzle needle 31, with which the nozzle needle rests on the stop plate 37 when magnetic coil is in the excited state and the armature 27 is attracted toward the magnetic coil. In the excited state, the sealing section 45 of the nozzle needle has risen from the valve seat 44, and fuel is capable of being ejected via the injection opening 43. The stop shoulder 48 is adjoined by a first guide section 49 of the nozzle needle 31, which in turn is adjoined by a cylindrical section 50 of reduced diameter and a second guide section 51 similar to guide section 49. The guide sections 49 and 51 provide guidance to the nozzle needle 31 in the guide bore 33 and are for instance embodied as square faces, so as to assure a flow around the nozzle needle 31 as the sealing section 45.

A blind bore 55 is provided in the head 30 of the nozzle needle 31, extending coaxially with and opening toward the core 7. An obliquely arranged bypass bore 56 discharges at the bottom of the blind bore 55, and opens toward the fuel chamber between the head 30 and the stop shoulder 48 of the nozzle needle 31, thereby enabling a return of the fuel to the fuel return line and enabling flushing out of undesired vapor bubbles. The diameter of the blind bore 55 is dimensioned such that a compression spring 57 can be supported on the end face, formed between the blind bore 55 and the connecting bore 29 of the armature 27, of the head 30 of the valve nozzle needle 31. On its other end, the compression spring 57 is supported on an end face of a bushing 60 secured in the connecting pipe 11 and tends to urge the valve needle 31 toward the valve seat face 44 and thereby to close the valve. The bushing 60 is secured in the connecting pipe 11 for instance by means of a tooth profile defined on the outer rim of the bushing 60 and having longitudinally extending teeth. Sealing between the bushing 60 and the connecting pipe 11 or core 7 is effected only on the end of the bushing 60 oriented toward the armature 27; otherwise, a through flow between the bushing 60 and the connecting pipe 11 is possible, in an annular gap 62 extending the entire length of the bushing 60. In the direction remote from the armature 27, the bushing 60 ends while still inside the connecting pipe 11, which in turn is provided at its end with a filter 61 embodied as a cap.

The valve housing 1, in the vicinity of the crimp 10, and, over a portion of its length, the connecting pipe 11 are surrounded by a plastic ring 65. The ring 65 has among other parts a plug 66, which receives a plug connection 67 connected to the contact lug 4. In the direction remote from the armature 27, the plastic ring 65 is adjoined by an annular fuel guide body 70 which also surrounds the connecting pipe 11. In its portion nearer the plastic ring 65, the fuel guide body 70 effects sealing from the outer jacket of the connecting pipe 11, while in the opposite direction, beginning at an annular collecting conduit 71 machined into the fuel guide body 70, a cylindrical gap 72 remains between the fuel guide body 70 and the connecting pipe 11. In the direction toward the armature 27, at least one first connecting conduit 73 leads from the collecting conduit 71 to at least one sleeve 74 extending axially parallel to the connecting pipe and serving to supply fuel. This sleeve 74 is seated at one end in a first receiving bore 75 of the fuel guide body 70, this bore 75 either communicates with or has the same dimension as the first connecting conduit 73, and at the other end the sleeve 74 is seated in a similar second receiving bore 76 in the flange 8 of the core 7. The second receiving bore 76 is extended in the form of a second connecting conduit 77 preferably extending coaxially with the sleeve 74, and in this way established communication with the interior 6 receiving the magnetic coil 3. The sleeve 74 is advantageously also surrounded by the plastic ring 65. In the direction remote from the armature 27, the annular gap 72 of the fuel guide body 70 is provided with a fuel filter 80. With a filter holder 81, this fuel filter 80 is seated on the outer jacket of the connecting pipe 11 and partly engages an edge 82 of the fuel guide body 70. The flow through the fuel filter 80 is thereby effected radially. An annular groove 83 is machined into the outer jacket of the fuel guide body 70 and a first sealing O-ring 84 is embedded in this groove 83; the sealing O-ring 84 serves to seal off the fuel guide body 70 with respect to a connecting flange 85 partly surrounding the fuel guide body.

Both the supply of fuel to the magnetic injection valve and the return flow of excess fuel are assured by a supply device 90. This supply device 90 may for instance be embodied as a metal profile having an inflow tract 91 and a return tract 92, with the inflow tract 91 having an inflow opening 93 and the return tract 92 having a return opening 94. The inflow opening 93 coaxially surrounds the return opening 94 such that the inflow opening 93 communicates in a sealing manner with the connecting flange 85, while the return opening 94 radially surrounds the connecting pipe 11 on its end remote from the armature 27. For sealing purposes, a second sealing O-ring 95 may be located between the return opening 94 and the connecting pipe 11.

The coil holder 2 receiving the magnetic coil 3 and accommodated in the interior 6 of the valve housing 1 has an outside diameter that is smaller than the diameter of the interior 6, so that the magnetic coil 3, or coil holder 2, has its outer jacket surrounded by a flow of fuel. The supply of fuel to the interior 6 of the valve housing 1 is effected as described above, via the second connecting conduit 77 in the flange 8. In the flat side of the coil holder 2 that rests on the magnetic flux conducting step 25, remote from the nozzle body 34, there are radially extending conduits 96, which in the vicinity of the inner bore of the coil holder extend in the form of axial conduits 97 to a predetermined length of the coil holder 2. Openings 98 provided radially in the coil holder 2 join these axial conduits 97 with an annular chamber 99 formed between the coil holder 2 and the outer jacket of the core 7. Both the individual radially extending conduits 96 and the axial conduits 97 may communicate with one another via various transverse conduits. The annular chamber 99, in turn, communicates by means of at least one outlet opening 100 with the annular gap 62 that is located between the connecting pipe 11 and the bushing 60.

The flow through the injection valve takes place, after the fuel has flowed through the fuel filter 80, via the annular gap 72 the annular collecting conduit 71, and through the sleeve 74 into the interior 6 and then flows along the coils to the radial conduits 96 and the axial conduits 97, via the openings 98 into the annular chamber 99 and via the outlet openings 100 into the annular gap 62 located between the connecting pipe 11 and the bushing 60. Here, the fuel flows on in the direction away from the valve; at the end of the bushing 60 it is turned around about the end face thereof and then flows all the way through the bushing 60 to the armature 27 and out through oblique bore 56 along the valve needle and out through the passage 43 when the electromagnet is excited.

Any vapor bubbles and highly volatile ingredients that may be dissolved in the fuel are transported through the central bore of the bushing 60 and on to the return tract 92 of the supply device 90.

By turning the fuel around twice in its course from the supply device 90 to the nozzle body 34 and by providing a flow of fuel surrounding the magnetic coil 3, very good cooling of the valve is attained with a large heat-transferring surface area. Because of the high volume of fuel stored in the valve, a large supply of readily atomizable bubble-free fuel is on hand for hot starting of the engine. This supply provides an adequate reserve for the first few critical seconds during the hot-starting phase.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A magnetic injection valve for injection of fuel into the intake tract of a mixture-compressing internal combustion engine, comprising a valve housing, a hollow fuel-carrying core made of ferromagnetic material and secured at one end in a coil holder (2) thereby cooperating with an armature in axial alignment with said core, a magnetic coil (2) secured on said coil holder and axially penetrated by at least part of said core and located in an interior of said valve housing through which fuel flows, a bushing secured inside said core forming an annular gap between said bushing and said core, said bushing being sealingly mounted in said core on an end of the bushing oriented toward said armature, and at least one opening in said core connecting said annular gap with said interior of said valve housing, said opening located on an end of said core nearer said armature, a fuel inlet, a fuel passage that extends from said fuel inlet to said interior of said valve housing with said passage communicating with said opening in said bushing, said annular gap permits fuel flow from said opening in said core to an upper end of said bushing through an interior of said bushing along its length to said valve needle, and said annular gap (62) and said interior of said bushing (60) discharge at an end of said bushing remote from said armature (27), into a fuel return (92) leading away from the magnetic injection valve, whereby the interior of the bushing (60) serves as a means of fuel flow to the armature (27) and to discharge excess fuel into said fuel return.

2. A magnetic injection valve as defined by claim 1, in which said opening (100) in said core is separated from said interior (6) such that a fuel flow virtually completely surrounds said magnetic coil.

3. A magnetic injection valve as defined by claim 2, which includes conduits that surround said magnetic coil to provide fuel flow surrounding said magnetic coil.

4. A magnetic injection valve as defined by claim 3, in which radially extending conduits (96) are formed in a flat side of said coil holder (2) that is remote from said inlet.

5. A magnetic injection valve as defined by claim 4, in which said radially extending conduits (96) communicate with one another by means of transverse conduits.

6. A magnetic injection valve as defined by claim 3, in which axially extending conduits (97) are formed in an inside of the coil holder (2) resting on said bushing (60).

7. A magnetic injection valve as defined by claim 4, in which axially extending conduits (97) are formed in an inside of the coil holder (2) resting on said bushing (60).

8. A magnetic injection valve as defined by claim 5, in which axially extending conduits (97) are formed in an inside of the coil holder (2) resting on said bushing (60).

9. A magnetic injection valve as defined by claim 6, in which said axially extending conduits communicate with one another by means of transverse conduits.

10. A magnetic injection valve as defined by claim 7, in which said axially extending conduits communicate with one another by means of transverse conduits.

11. A magnetic injection valve as defined by claim 8, in which said axially extending conduits communicate with one another by means of transverse conduits.

12. A magnetic injection valve as defined by claim 1, in which said bushing (60) terminates below the core (7), juxtaposed said fuel return.

13. A magnetic injection valve as defined by claim 6, in which said bushing (60) terminates below the core (7) juxtaposed said fuel return.

14. A magnetic injection valve as defined by claim 12, which includes a filter (61) secured on an end of said core (7) juxtaposed said fuel return.

15. A magnetic injection valves defined by claim 13, which includes a filter (61) secured on an end of said core (7) juxtaposed said fuel return.

16. A magnetic injection valve as defined by claim 1, in which said fuel passage is formed by a fuel guide body (70) embodied as a cylindrical body mounted on said core (7), a collecting conduit (71) which surrounds said core (7), a receiving bore (75), and a sleeve (74), that extends to said interior (6).

17. A magnetic injection valve as defined by claim 6, in which said fuel passage is formed by a fuel guide body (70) embodied as a cylindrical body mounted on said core (7), a collecting conduit (71) which surrounds said core (7), a receiving bore (75), and a sleeve (74), that extends to said interior (6).

18. A magnetic injection valve as defined by claim 12, in which said fuel passage is formed by a fuel guide body (70) embodied as a cylindrical body mounted on said core (7), a collecting conduit (71) which surrounds said core (7), a receiving bore (75), and a sleeve (74), that extends to said interior (6).

19. A magnetic injection valve as defined by claim 16, which includes a fuel filter (80) located such that it rests on an end of the fuel guide body (70) oriented toward said inlet (90) and partially surrounds said core through which fuel flows radially.

* * * * *